US007562506B2

(12) United States Patent
Hohmann, Jr.

(10) Patent No.: US 7,562,506 B2
(45) **Date of Patent: *Jul. 21, 2009**

(54) NOTCHED SURFACE-MOUNTED ANCHORS AND WALL ANCHOR SYSTEMS USING THE SAME

(75) Inventor: Ronald P. Hohmann, Jr., Hauppauge, NY (US)

(73) Assignee: MiTek Holdings, Inc., Wilmington, DE (US)

( * ) Notice: Subject to any disclaimer, the term of this patent is extended or adjusted under 35 U.S.C. 154(b) by 673 days.

This patent is subject to a terminal disclaimer.

(21) Appl. No.: 11/223,574

(22) Filed: Sep. 9, 2005

(65) Prior Publication Data

US 2006/0005490 A1 Jan. 12, 2006

Related U.S. Application Data

(63) Continuation-in-part of application No. 10/785,209, filed on Feb. 24, 2004, which is a continuation-in-part of application No. 10/426,993, filed on Apr. 30, 2003, now Pat. No. 6,925,768.

(51) Int. Cl.
*E04B 1/38* (2006.01)
*E04B 1/02* (2006.01)

(52) U.S. Cl. ..... 52/714; 52/565; 52/383

(58) Field of Classification Search ..... 52/379, 52/383, 508, 513, 565, 713, 714
See application file for complete search history.

(56) References Cited

U.S. PATENT DOCUMENTS 1,854,633 A * 4/1932 Stephens ..... 52/215
2,058,148 A 10/1936 Hard
2,966,705 A 1/1961 Massey
3,377,764 A 4/1968 Storch
4,021,990 A 5/1977 Schwalberg
4,210,301 A * 7/1980 Weiss ..... 248/48.2
4,305,239 A 12/1981 Geraghty
4,373,314 A 2/1983 Allan
4,438,611 A 3/1984 Bryant
4,473,984 A 10/1984 Lopez (Continued)

FOREIGN PATENT DOCUMENTS

CH 279209 3/1952

(Continued)

OTHER PUBLICATIONS

Energy Envelope Requirements, 780 CMR sec. 1304.0 et seq. of chapter 13; Boston, MA, Jan. 1, 2001.

*Primary Examiner*—Brian E Glessner
*Assistant Examiner*—Adriana Figueroa
(74) *Attorney, Agent, or Firm*—Siegmar Silber, Esq.

(57) ABSTRACT

Notched, surface-mounted wall anchors and anchoring systems employing the same are disclosed. The anchor is a notched, folded sheetmetal construct utilizable with various wire formative veneer ties. The depth of the notch is greater than the combined thickness of the wallboard and the waterproofing layer. Various embodiments show wall anchor configurations with suitable veneer ties and differing sheathing arrangements. The notches, upon surface-mounting of the wall anchor, form small wells in the portion of the notch extending into the insulation, which wells entrain water vapor, condensate and water, and relieve the same from being driven into the wallboard.

18 Claims, 9 Drawing Sheets

U.S. PATENT DOCUMENTS

| | | | | | |
|---|---|---|---|---|---|
| 4,598,518 | A | | 7/1986 | Hohmann | |
| 4,764,069 | A | | 8/1988 | Reinwall | |
| 4,869,038 | A | | 9/1989 | Catani | |
| 4,869,043 | A | | 9/1989 | Hatzinikolas | |
| 4,875,319 | A | * | 10/1989 | Hohmann | 52/383 |
| 4,918,893 | A | * | 4/1990 | Vandenbroucke et al. | 52/404.2 |
| 5,063,722 | A | * | 11/1991 | Hohmann | 52/410 |
| 5,392,581 | A | | 2/1995 | Hatzinikolas | |
| 5,408,798 | A | | 4/1995 | Hohmann | |
| 5,456,052 | A | | 10/1995 | Anderson | |
| 5,816,008 | A | | 10/1998 | Hohmann | |
| 6,209,281 | B1 | | 4/2001 | Rice | |
| 6,279,283 | B1 | | 8/2001 | Hohmann | |
| 6,726,155 | B1 | * | 4/2004 | Zimmerman | 248/48.1 |

FOREIGN PATENT DOCUMENTS

| | | |
|---|---|---|
| GB | 2069024 | 8/1981 |

* cited by examiner

NOTCHED SURFACE-MOUNTED ANCHORS AND WALL ANCHOR SYSTEMS USING THE SAME

CROSS-REFERENCES TO RELATED APPLICATIONS

This application is a continuation-in-part of U.S. patent application entitled HIGH-STRENGTH SURFACE-MOUNTED ANCHORS AND WALL ANCHOR SYSTEMS USING THE SAME, Ser. No. 10/785,209 filed Feb. 24, 2004, which application is, in turn, a continuation-in-part of U.S. patent application entitled FOLDED WALL ANCHOR AND SURFACE-MOUNTED ANCHORING, Ser. No. 10/426,993, filed Apr. 30, 2003, now U.S. Pat. No. 6,925,768.

BACKGROUND OF THE INVENTION

1. Field of the Invention

This invention relates to notched wall anchors and to surface-mounted anchoring systems employing the same, both of which are used in cavity wall constructs. More particularly, the invention relates to sheetmetal wall anchors and wire formative veneer ties that comprise positive interlocking components of the anchoring system. The system has application to seismic-resistant structures and to cavity walls having special requirements. The latter include high-strength requirements for both insulated and non-insulated cavities, namely, a structural performance characteristic capable of withstanding a 100 lbf, in both tension and compression.

2. Description of the Prior Art

In the late 1980's, surface-mounted wall anchors were developed by Hohmann & Barnard, Inc., and patented under U.S. Pat. No. 4,598,518 of the first-named inventor hereof. The invention was commercialized under trademarks DW-10, DW-10-X, and DW-10-HS. These widely accepted building specialty products were designed primarily for dry-wall construction, but were also used with masonry backup walls. For seismic applications, it was common practice to use these wall anchors as part of the DW-10 Seismiclip interlock system which added a Byna-Tie wire formative, a Seismiclip snap-in device—described in U.S. Pat. No. 4,875,319 ('319), and a continuous wire reinforcement.

In an insulated dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max.). The interlock system served well and received high scores in testing and engineering evaluations which examined effects of various forces, particularly lateral forces, upon brick veneer masonry construction. However, under certain conditions, the system did not sufficiently maintain the integrity of the insulation. Also, upon the promulgation of more rigorous specifications by which tension and compression characteristics were raised, a different structure—such as one of those described in detail below—was required.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gauge sheetmetal and provided horizontally disposed openings in the arms thereof for pintle legs of the veneer anchor. In general, the pintle-receiving sheetmetal version of the Seismiclip interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud which include an elongated eye and a wire tie therethrough for deposition in a bed joint of the outer wythe. It is instructive to note that pin-point loading—that is forces concentrated at substantially a single point—developed from this design configuration. This resulted, upon experiencing lateral forces over time, in the loosening of the stud.

Exemplary of the public sector building specification is that of the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe.

As insulation became thicker, the tearing of insulation during installation of the pronged DW-10X wall anchor, see supra, became more prevalent. This occurred as the installer would fully insert one side of the wall anchor before seating the other side. The tearing would occur at two times, namely, during the arcuate path of the insertion of the second leg and separately upon installation of the attaching hardware. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable. The improvements hereinbelow in surface mounted wall anchors look toward greater insulation integrity and less reliance on a patch.

Another prior art development occurred shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the veneer. The underlying sheetmetal plate is highly thermally conductive, and the '581 patent describes lowering the thermal conductivity by foraminously structuring the plate. However, as there is no thermal break, a concomitant loss of the insulative integrity results.

In recent building codes for masonry structures, a trend away from eye and pintle structures is seen in that the newer codes require adjustable anchors be detailed to prevent disengagement. This has led to anchoring systems in which the open end of the veneer tie is embedded in the corresponding bed joint of the veneer and precludes disengagement by vertical displacement.

Another application for high-span anchoring systems is in the evolving technology of self-cooling buildings. Here, the cavity wall serves additionally as a plenum for delivering air from one area to another. While this technology has not seen wide application in the United States, the ability to size cavities to match air moving requirements for naturally ventilated buildings enable the architectural engineer to now consider cavity walls when designing structures in this environmentally favorable form.

In the past, the use of wire formatives have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. This led to the low-profile wall anchors of the inventors hereof as described in U.S. Pat. No. 6,279,283. However, the above-described technology did not address the adaption thereof to surface mounted devices.

In the course of prosecution of U.S. Pat. No. 4,598,518 (Hohmann '518) several patents, indicated by an asterisk on the tabulation below, became known to the inventors hereof and are acknowledged hereby. Thereafter and in preparing for this disclosure, the additional patents which became known to the inventors are discussed further as to the significance thereof:

| Pat. | Inventor | O. Cl. | Issue Date |
|---|---|---|---|
| 2,058,148* | Hard | 52/714 | October 1936 |
| 2,966,705* | Massey | 52/714 | January 1961 |
| 3,377,764 | Storch | | Apr. 16, 1968 |
| 4,021,990* | Schwalberg | 52/714 | May 10, 1977 |
| 4,305,239* | Geraghty | 52/713 | December 1981 |
| 4,373,314 | Allan | | Feb. 15, 1983 |
| 4,438,611* | Bryant | 52/410 | March 1984 |
| 4,473,984 | Lopez | | Oct. 2, 1984 |
| 4,598,518 | Hohmann | | Jul. 8, 1986 |
| 4,869,038 | Catani | | Sep. 26, 1989 |
| 4,875,319 | Hohmann | | Oct. 24, 1989 |
| 5,063,722 | Hohmann | | Nov. 12, 1991 |
| 5,392,581 | Hatzinikolas et al. | | Feb. 28, 1995 |
| 5,408,798 | Hohmann | | Apr. 25, 1995 |
| 5,456,052 | Anderson et al. | | Oct. 10, 1995 |
| 5,816,008 | Hohmann | | Oct. 15, 1998 |
| 6,209,281 | Rice | | Apr. 3, 2001 |
| 6,279,283 | Hohmann et al | | Aug. 28, 2001 |
| | Foreign Patent Documents | | |
| 279209* | CH | 52/714 | March 1952 |
| 2069024* | GB | 52/714 | August 1981 |

Note:
Original classification provided for asterisked items only.

It is noted that with some exceptions these devices are generally descriptive of wire-to-wire anchors and wall ties and have various cooperative functional relationships with straight wire runs embedded in the inner and/or outer wythe.

U.S. Pat. No. 3,377,764—D. Storch—Issued Apr. 16, 1968

Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977

Discloses a dry wall construction system for anchoring a facing veneer to wallboard/metal stud construction with a pronged sheet-metal anchor. Like Storch '764, the wall tie is embedded in the exterior wythe and is not attached to a straight wire run.

U.S. Pat. No. 4,373,314—J. A. Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued Sep. 26, 1989

Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319—R. Hohmann—Issued Oct. 24, 1989

Discloses a seismic construction system for anchoring a facing veneer to wallboard/metal stud construction with a pronged sheet-metal anchor. Wall tie is distinguished over that of Schwalberg '990 and is clipped onto a straight wire run.

U.S. Pat. No. 5,392,581—Hatzinikolas et al.—Issued Feb. 28, 1995

Discloses a cavity-wall anchor having a conventional tie wire for mounting in the brick veneer and an L-shaped sheet-metal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995

Discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer.

U.S. Pat. No. 5,456,052—Anderson et al.—Issued Oct. 10, 1995

Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 15, 1998

Discloses a brick veneer anchor primarily for use with a cavity wall with a drywall inner wythe. The device combines an L-shaped plate for mounting on the metal stud of the drywall and extending into the cavity with a T-head bent stay.

After interengagement with the L-shaped plate the free end of the bent stay is embedded in the corresponding bed joint of the veneer.

U.S. Pat. No. 6,209,281—Rice—Issued Apr. 3, 2001

Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001

Discloses a low-profile wall tie primarily for use in renovation construction where in order to match existing mortar height in the facing wythe a compressed wall tie is embedded in the bed joint of the brick veneer.

None of the above provide the notched, surface-mounted wall anchor or anchoring systems utilizing these devices of this invention. As will become clear in reviewing the disclosure which follows, the cavity wall structures benefit from the recent developments described herein that lead to solving the problems of insulation and waterproofing membrane integrity. In the related application, folded wall anchors are structured with legs that are mounted inboard to the baseplate thereby enabling the baseplate to cover the insertion openings. Here, further improvements in surface-mounted anchors and systems including notched, surface-mounted anchors are introduced.

SUMMARY

In general terms, the invention disclosed hereby is a unique surface mounted wall anchor and an anchoring system employing the same. The wall anchor is a sheetmetal device which is described herein as functioning with various wire formative veneer ties. In two embodiments, enfolded legs have a projecting portion and a nonprojecting portion. The folded construction of the wall tie enables the junctures of the legs and the base of the wall anchor to be located inboard from the periphery of the wall anchor. During formation of the wall anchor, the outer surface of the nonprojecting portion of the enfolded leg and the underside of the base are caused to be coplanar. Upon installation, the coplanar elements act to seal the insertion point where the legs enter into the exterior layer of building materials on the inner wythe. This sealing effect precludes the penetration of air, moisture, and water vapor into the inner wythe structure. In all of the embodiments shown, the legs are formed to fully or partially sheath the mounting hardware of the wall anchor. The sheathing function reduces the openings in the insulation required for installing the wall anchor.

In the first embodiment, the folded wall anchor is adapted from the earlier inventions of Schwalberg, U.S. Pat. No. 4,021,990 and of Hohmann, U.S. Pat. No. 4,875,319, see supra. Here it is seen that the double folded wall anchor (with legs moved inboard) have deeply impressed ribs alongside the bail, which creates a wall anchor construct of superior strength. This construct is applied to an insulated dry wall inner wythe having insulation over wallboard cavity, and an outer wythe of brick. The channel in the projecting portion of the legs ensheaths the interior side of the mounting hardware and the notch minimizes penetration through wallboard and the associated waterproofing membrane.

In the second embodiment, the folded wall anchor is of the winged variety. The wings in this embodiment are slotted and permit continuously adjustable positioning of the veneer tie. Here it is seen that a double folded wall anchor together with a box veneer tie is applied to a dry wall inner wythe having exterior insulation and, thus, the wall anchor legs have to penetrate the insulation, the waterproofing membrane, and the wallboard layers. In the third embodiment, the wings are slotted with a centrally disposed reinforcement bar. The folded wall anchor is paired with a canted, low-profile veneer anchor. The folded wall anchor is surface-mounted to an inner wythe also having insulation on the exterior surface with wallboard and waterproofing membrane and a brick facing. The use of this innovative surface-mounted wall anchor in various applications addresses the problems of insulation integrity, thermal conductivity, and pin-point loading encountered in the previously discussed inventions.

OBJECTS AND FEATURES OF THE INVENTION

Accordingly, it is the primary object of the present invention to provide a new and novel anchoring systems for cavity walls, which systems are surface mountable to the backup wythe thereof.

It is another object of the present invention to provide a new and novel wall anchor mounted on the exterior surface of the the insulation layer, the wallboard, and the waterproofing membrane layers and secured to the metal stud or standard framing member of a dry wall construction.

It is yet another object of the present invention to provide an anchoring system which is resistive to water penetrating the wallboard protective covering, to high levels of tension and compression and, further, to prevent disengagement under seismic or other severe environmental conditions.

It is still yet another object of the present invention to provide an anchoring system which is constructed to maintain insulation and waterproofing membrane integrity by preventing air and water penetration thereinto.

It is a feature of the present invention that the wall anchor hereof requires smaller openings in the insulation for installation and has a coplanar baseplate for sealing against the insertion points in the insulation.

It is another feature of the present invention that the legs of the wall anchor hereof have only point contact with the metal studs with substantially no resultant thermal conductivity.

It is yet another feature of the present invention that the bearing area between the wall anchor and the veneer tie spreads the forces thereacross and avoids pin-point loading.

Other objects and features of the invention will become apparent upon review of the drawing and the detailed description which follows.

BRIEF DESCRIPTION OF THE DRAWING

In the following drawing, the same parts in the various views are afforded the same reference designators.

DESCRIPTION OF THE PREFERRED EMBODIMENTS

Figure 1:
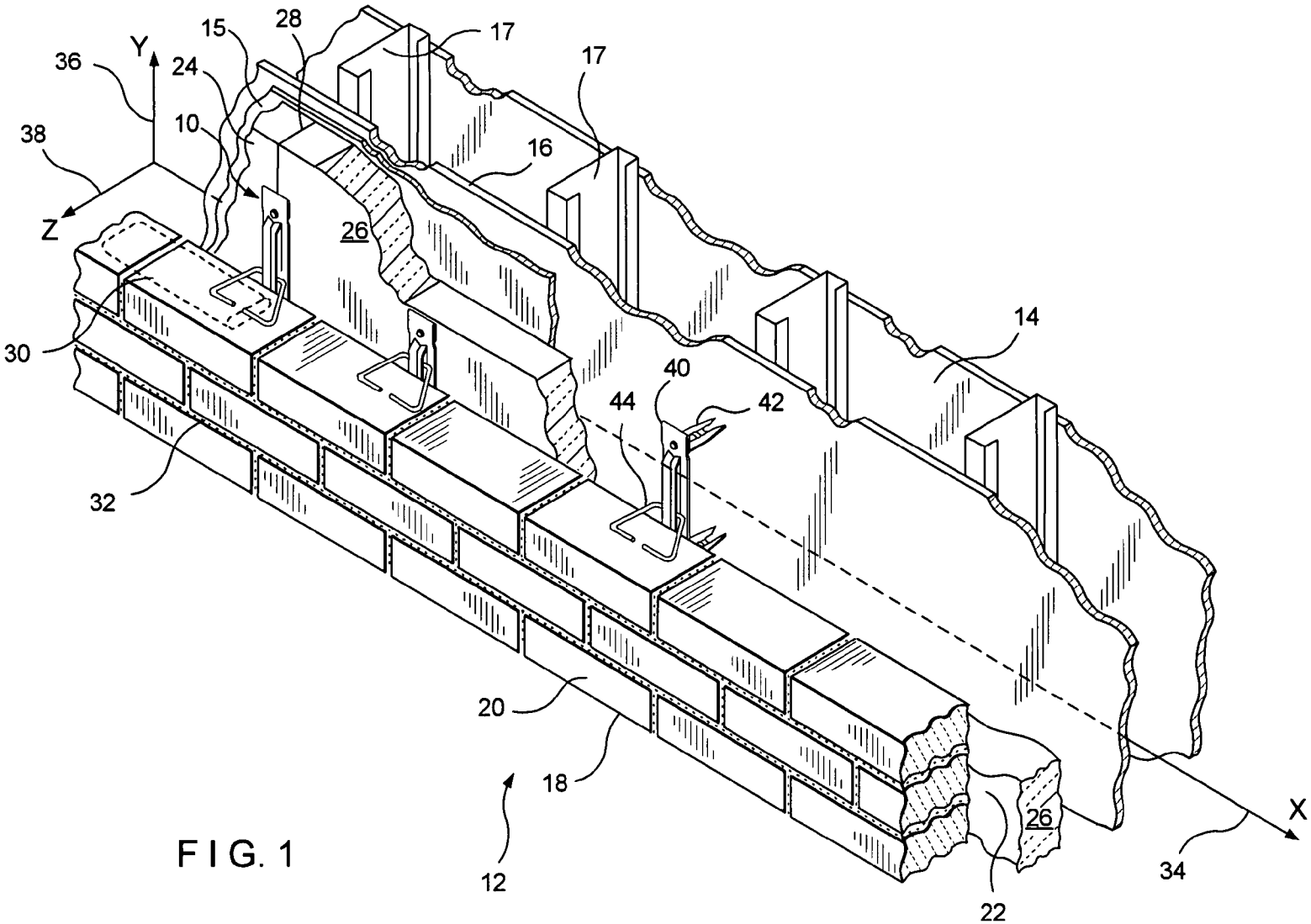
FIG. 1 shows a first embodiment of this invention and is a perspective view of a notched, surface-mounted anchoring system as applied to a cavity wall with an inner wythe of dry wall construction having insulation and a waterproofing membrane disposed on the cavity-side thereof and an outer wythe of brick.

Before entering into the detailed Description of the Preferred Embodiments, several terms which will be revisited later are defined. These terms are relevant to discussions of innovations introduced by the improvements of this disclosure that overcome the technical shortcoming of the prior art devices.

In the embodiments described hereinbelow, the inner wythe is provided with insulation. In the dry wall construction shown in the embodiments hereof, this takes the form of exterior insulation disposed on the outer surface of the inner wythe. Further between the wallboard and the insulation a protective waterproofing membrane is present to preclude water from damaging the wallboard. Recently, building codes have required that after the anchoring system is installed and, prior to the inner wythe being closed up, that an inspection be made for insulation integrity to ensure that the insulation prevents infiltration of air and moisture. Here the term insulation integrity is used in the same sense as the building code in that, after the installation of the anchoring system, there is no change or interference with the insulative properties and concomitantly substantially no change in the air and moisture infiltration characteristics. It is noted that in contradistinction to the related application cited hereinabove, by notching the wall anchor legs, these wall anchor systems are designed to be less invasive into the insulation and the waterproofing membrane.

In a related sense, prior art sheetmetal anchors have formed a conductive bridge between the wall cavity and the metal studs of columns of the interior of the building. Here the terms thermal conductivity and thermal conductivity analysis are used to examine this phenomenon and the metal-to-metal contacts across the inner wythe.

Anchoring systems for cavity walls are used to secure veneer facings to a building and overcome tension and compression from seismic and other forces, i.e. wind shear, etc. In the past, some systems have experienced failure because the forces have been concentrated at substantially a single point. Here, the term pin-point loading refers to an anchoring system wherein forces are concentrated at a single point.

In addition to that which occurs at the facing wythe, attention is further drawn to the construction at the exterior surface of the inner or backup wythe. Here there are two concerns, namely, maximizing the strength of the securement of the surface-mounted wall anchor to the backup wall and, as previously discussed minimizing the interference of the anchoring system with the insulation and the waterproofing. The first concern is addressed using appropriate fasteners such as, for mounting to metal, dry-wall studs, self-tapping screws. The latter concern is addressed by the flatness of the base of the surface-mounted, folded anchors covering the openings formed by the legs (the profile is seen in the cross-sectional drawings of FIGS. 4 and 7) and by the notched leg portion minimizing the openings in the waterproofing membrane.

In the detailed description, the veneer reinforcements and the veneer anchors are wire formatives. The wire used in the fabrication of veneer joint reinforcement conforms to the requirements of ASTM Standard Specification A951-00, Table 1. For the purpose fo this application tensile strength tests and yield tests of veneer joint reinforcements are, where applicable, those denominated in ASTM A-951-00 Standard Specification for Masonry Joint Reinforcement.

Referring now to FIGS. 1 through 4, the first embodiment shows an anchoring system with a notched, surface-mounted wall anchor. This system is suitable for recently promulgated standards and, in addition, has greater tension and compression characteristics. The system discussed in detail hereinbelow, has a notched, folded wall anchor and an interengaging veneer tie. The wall anchor is surface mounted onto an externally insulated dry wall that has a waterproofing membrane between the wallboard and the insulation. For the first embodiment, a cavity wall having an insulative layer of 2.5 inches (approx.) and a total span of 3.5 inches (approx.) is chosen as exemplary.

The surface-mounted anchoring system for cavity walls is referred to generally by the numeral 10. A cavity wall structure 12 is shown having an inner wythe or dry wall backup 14 with a waterproofing membrane 15 disposed thereon. Sheetrock or wallboard 16 is mounted on metal studs or columns 17 and an outer wythe or facing wall 18 of brick 20 construction. Between the inner wythe 14 and the outer wythe 18, a cavity 22 is formed. The cavity 22, which has a 3.5-inch span, has attached to the exterior surface 24 of the waterproofing membrane 15 insulation in the form of insulating panels 26. Seams 28 between adjacent panels of insulation 26 are shown as being substantially vertical and each in alignment with the center of a column 17; however, horizontal insulating panels may also be used with the anchoring system described herein.

Successive bed joints 30 and 32 are substantially planar and horizontally disposed and in accord with building standards are 0.375-inch (approx.) in height. Selective ones of bed joints 30 and 32, which are formed between courses of bricks 20, are constructed to receive therewithin the insertion portion of the veneer anchor of the anchoring system hereof. Being surface mounted onto the inner wythe, the anchoring system 10 is constructed cooperatively therewith and is configured to minimize air and moisture penetration around the wall anchor system/inner wythe juncture.

For purposes of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes. A folded wall anchor 40 is shown which has a pair of legs 42 which penetrate the insulation 26, the waterproofing membrane 15, and the wallboard 16. Folded wall anchor 40 is a stamped metal construct which is constructed for surface mounting on inner wythe 14 and for interconnection with veneer tie 44.

The veneer tie 44 is a wire formative of a gage close to the receptor opening measured in an xz plane. The veneer tie 44 is shown in FIG. 1 as being emplaced on a course of bricks 20 in preparation for embedment in the mortar of bed joint 30. In this embodiment, the system includes a wall anchor 40 and a veneer tie 44.

Figure 2:
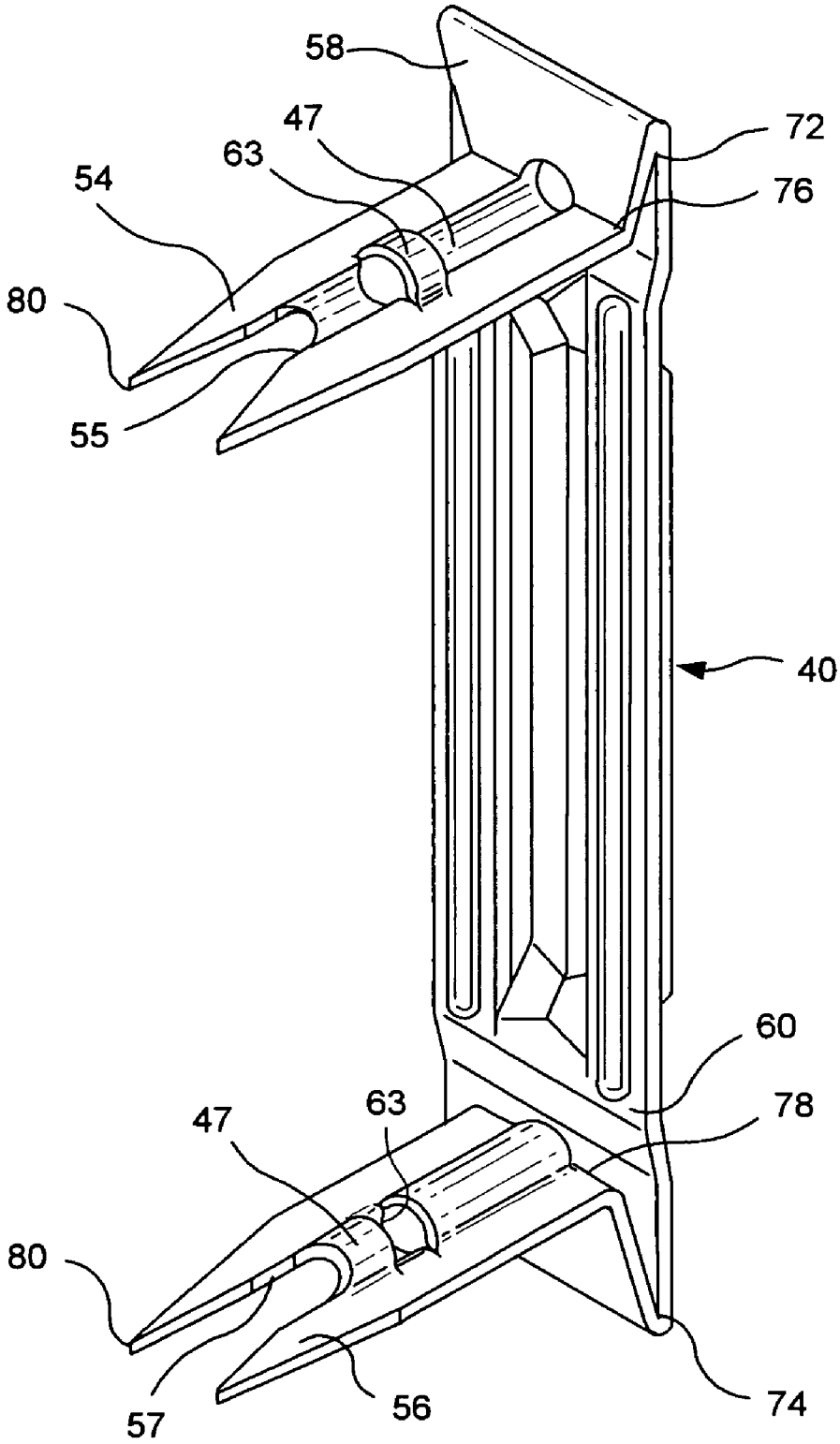
FIG. 2 is a rear perspective view showing the folded wall anchor of the surface-mounted anchoring system of FIG. 1 for ensheathing the interior of the mounting hardware.

At intervals along a horizontal line on the outer surface of insulation 26, the folded wall anchors 40 are surface mounted. The legs 42 on the anchors 40 each have a base surface 58 and a pair of leg portions 54 and 56 extending from the base surface. In this structure, channels 47 sheathe the interior of mounting hardware 48. The folded wall anchors 40 are positioned on the outer surface of insulation 26 so that the longitudinal axis of a column 17 lies within the yz-plane formed by the longitudinal axes 50 and 52 of upper leg portion 54 and lower leg portion 56, respectively. The leg portions 54 and 56 are folded, extending from a locating within the perimeter of the mounting surface, as best shown in FIG. 2, so that the base surface 58 of the legs and the base surface 60 of the bail portion 62 are substantially coplanar and, when installed, lie in an xy-plane. Upon insertion in insulation 26, the base surfaces 58 and 60 rest snugly against the opening formed thereby and serves to cover the opening precluding the passage of air and moisture therethrough. This construct maintains the insulation integrity.

Support for this amendment can be found in FIG 2. FIG. 2 clearly shows the legs extending from a location within the perimeter of the mounting surface.

The upper leg portion 54 and the lower leg portion 56 of folded wall anchors 40 have the lower portion of channels 47 removed thereby forming upper notch 55 and lower notch 57. The depth 59 of the notches 55 and 57 is slightly greater than the combined height of the wallboard 16 and the waterproofing membrane 15. The notch excesses form small wells 61 which draw off moisture, condensate or water from the associated leg portion or hardware and serves to relieve any pressure which would drive the same past the waterproofing membrane 15 and toward wallboard 16. This construct maintains the waterproofing integrity.

The upper leg portion 54 and lower leg portion 56 of folded wall anchor 40 have formed into each of the channels 47 a screw guide 63. As insulation becomes thicker in accordance with typical Energy Code requirements (see Background of the Invention, supra, the need for installation aids such as the screw guide hereof takes on greater importance. The screw guide 63 ensures that mounting hardware 48 remains substantially aligned with z-axis 38 during installation. By having a complete ring-like 360° portion or strap in the sheathing channel 47, the mounting hardware is encaptured or strapped into position in a positive manner.

The dimensional relationship between wall anchor 40 and veneer tie 44 limits the axial movement of the construct. Each veneer tie 44 has a rear leg 64 opposite the bed-joint-deposited portion thereof which is formed continuous therewith. The slot or bail aperture 66 of bail 62 is constructed, in accordance with the building code requirements, to be within the predetermined dimensions to limit the z-axis 38 movement. The slot 66 is slightly larger horizontally than the diameter of the tie. The receptor opening or bail slot 66 is elongated vertically to accept a veneer tie threadedly therethrough and permit y-axis 36 adjustment. The dimensional relationship of the rear leg 64 to the width of bail 62 limits the x-axis movement of the construct. The front legs 68 and 70 are dimensioned for insertion in bed joint 30.

Figure 3:
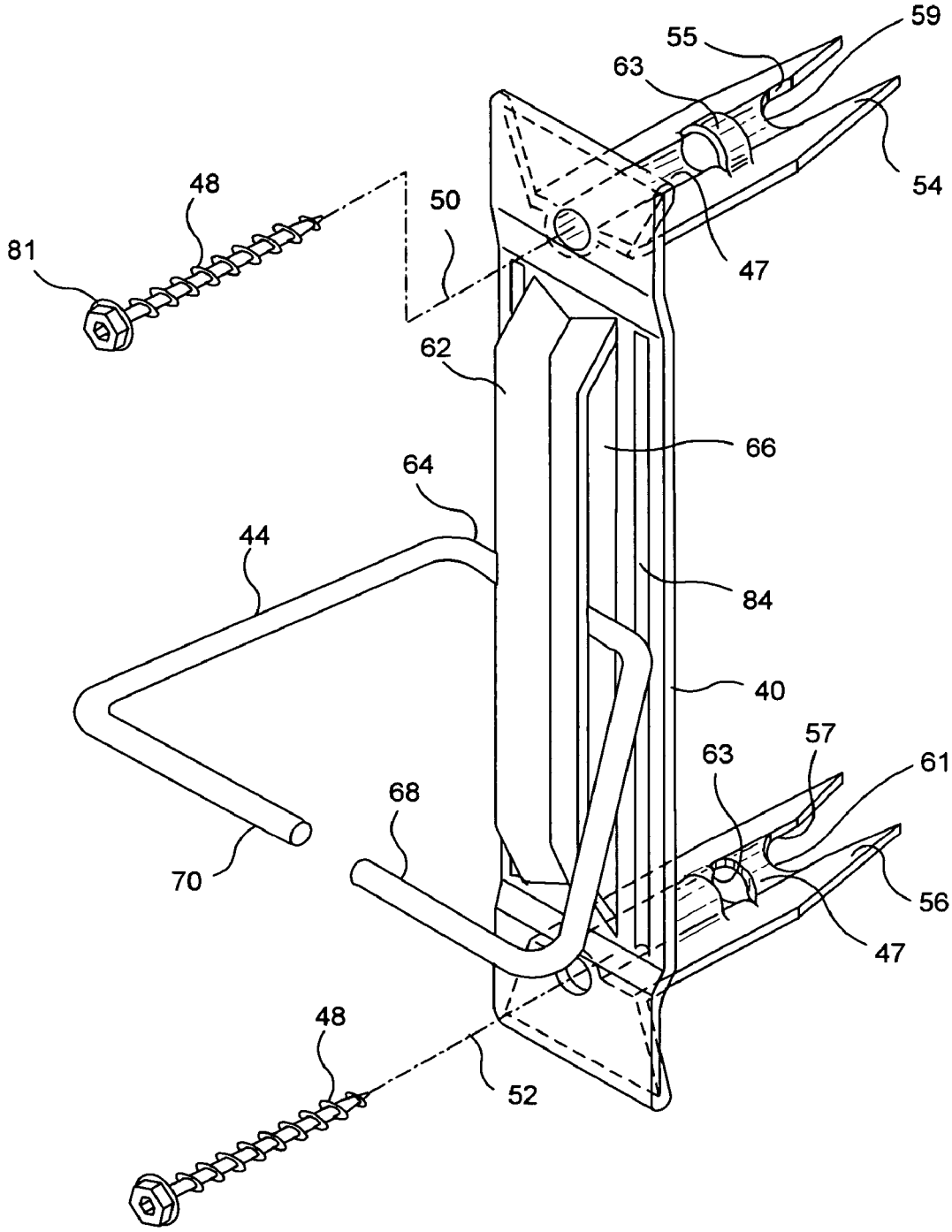
FIG. 3 is a perspective view of the surface-mounted anchoring system of FIG. 1 shown with a folded wall anchor and a veneer tie threaded therethrough.
Figure 4:
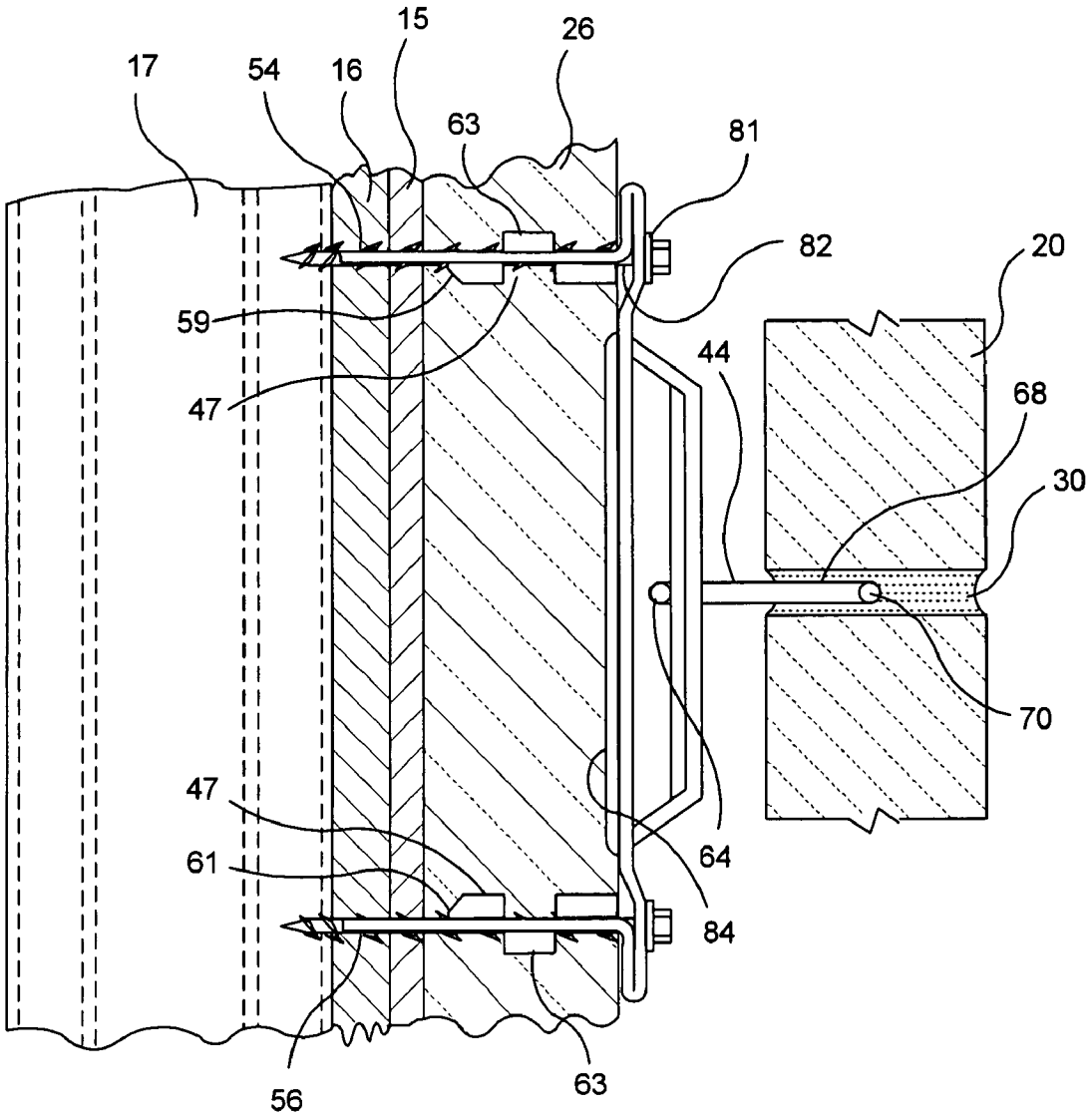
FIG. 4 is a cross sectional view of FIG. 1 which shows the relationship of the surface-mounted anchoring system of this invention to the above-described dry-wall construction and to the brick outer wythe.

The folded wall anchor 40 is seen in more detail in FIGS. 2 through 4. The legs 42 are folded 180° about end seams 72 and 74, respectively, and then 90° at the inboard seams 76 and 78, respectively, so as to extend parallel the one to the other. The leg portions 54 and 56 are dimensioned so that, upon installation, they extend through insulation panels 26, waterproofing membrane 15, and wallboard 16 and the endpoints 80 thereof abut the metal studs 17. Although only two-leg structures are shown, it is within the contemplation of this invention that more folded legs could be constructed with each leg terminating at an inboard seam and having the insertion point 82 of the insulation 26 covered by the wall anchor body. Because the leg portions 54 and 56 abut the studs 17 only at endpoints 80, the thermal conductivity across the construct is minimal as the cross sectional metal-to-metal contact area is minimized. (There is virtually no heat transfer across the mounting hardware 48 because of the isolating, nonconductive washers 81.

In this embodiment, as best seen in FIGS. 3 and 4, strengthening ribs 84 are impressed in the base 60 of wall anchor 40. The ribs 84 are substantially parallel to the bail opening 66 and, when mounting hardware 48 is fully seated so that the base surface 60 rests against the face of insulation 26, the ribs 84 are then pressed into the surface of the insulation 26. This provides additional sealing. While the ribs 84 are shown as protruding toward the insulation, it is within the contemplation of this invention that ribs 84 could be raised in the opposite direction. The alternative structure would be used in applications wherein the outer layer of the inner wythe is noncompressible and does not conform to the rib contour. The ribs 84 strengthen the wall anchor 40 and achieves an anchor with a tension and compression rating of 100 lbf.

Figure 5:
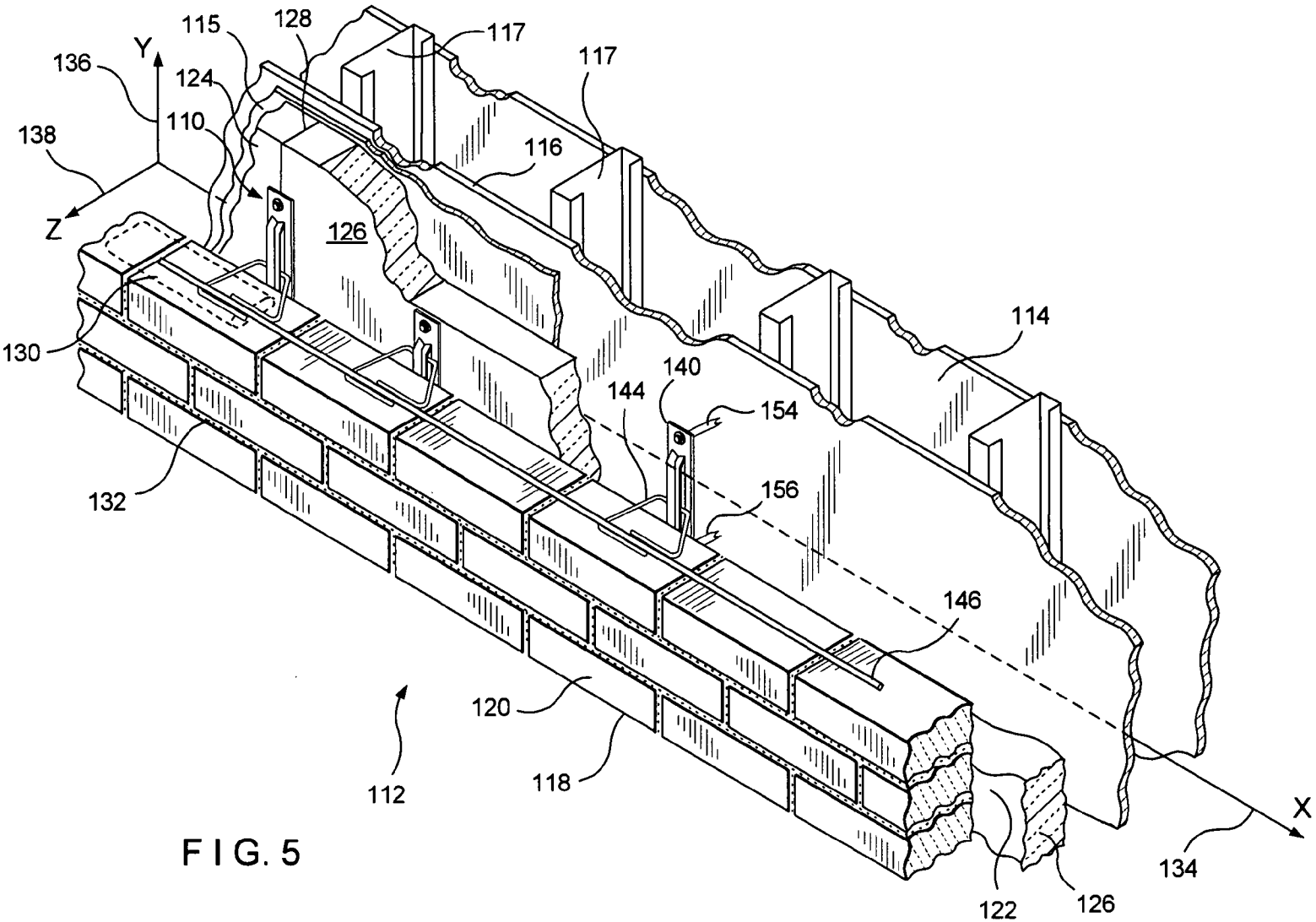
FIG. 5 is a perspective view of a second embodiment of this invention showing a surface-mounted anchoring system for a seismic-resistant cavity wall and is similar to FIG. 1, but shows wall anchors with tubular legs and a swaged veneer tie accommodating a reinforcing bar in the bed joints of the brick outer wythe.
Figure 6:
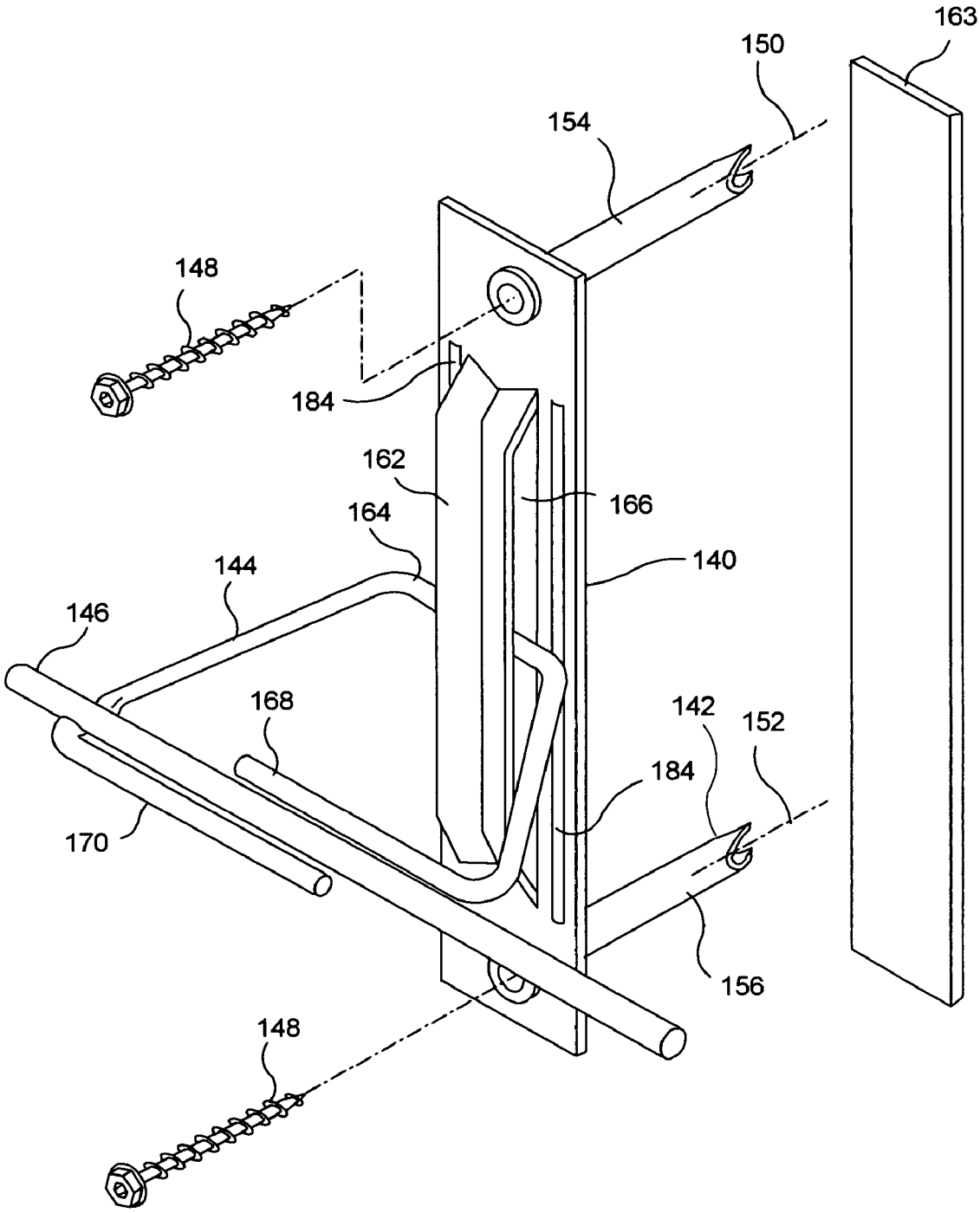
FIG. 6 is a rear perspective view showing the surface-mounted anchoring system having a wall anchor with notched tubular legs of FIG. 5.
Figure 7:
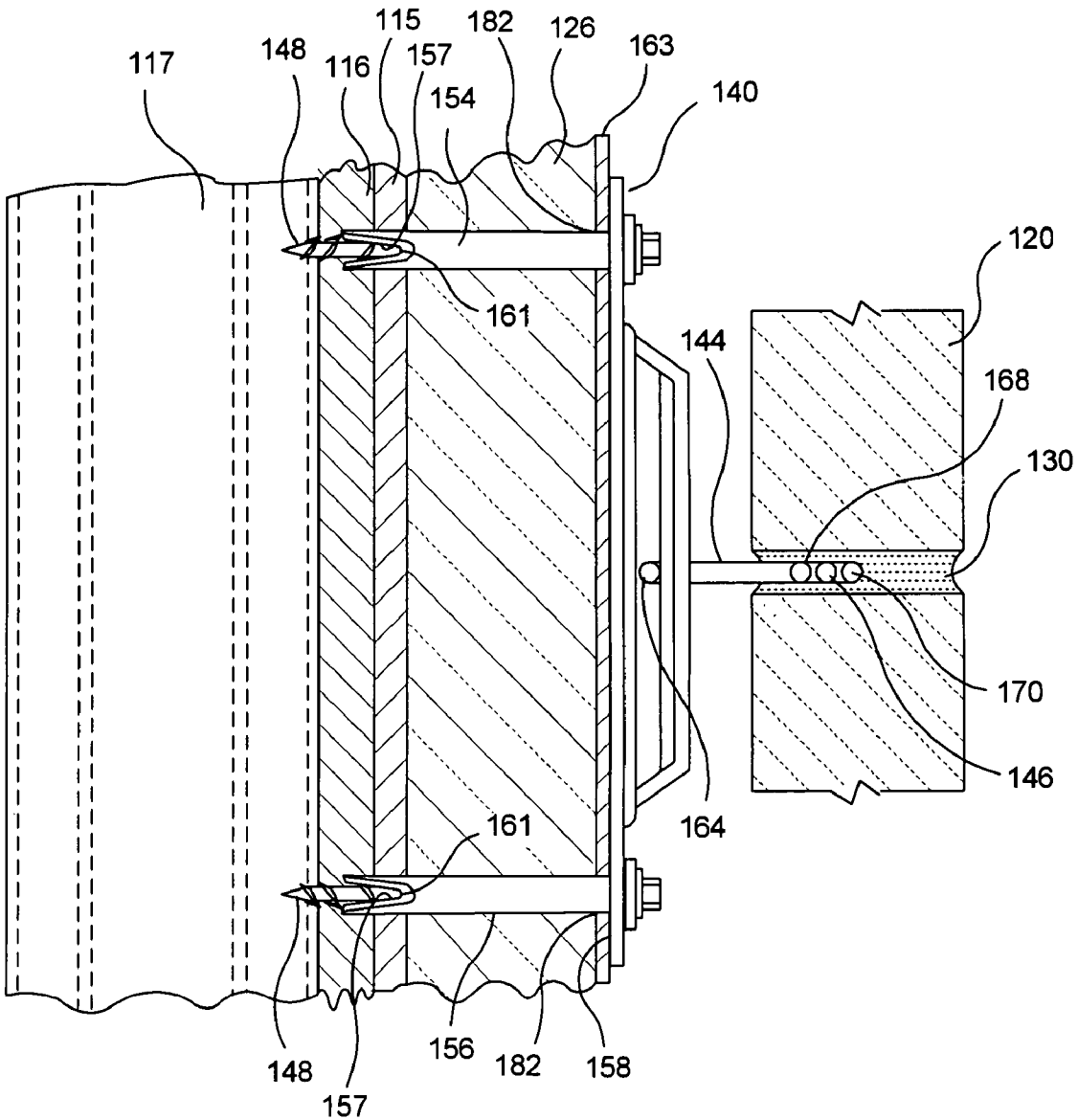
FIG. 7 is a cross sectional view of FIG. 5 which shows the relationship of the surface-mounted wall anchor with tubular legs and the corresponding swaged veneer tie and reinforcing bar.

The description which follows is a second embodiment of the surface-mounted anchoring system for cavity walls of this invention. For ease of comprehension, wherever possible similar parts use reference designators 100 units higher than those above. Thus, the veneer tie 144 of the second embodiment is analogous to the veneer tie 44 of the first embodiment. Referring now to FIGS. 5 through 7, the second embodiment of the surface-mounted anchoring system is shown and is referred to generally by the numeral 110. As in the first embodiment, a wall structure 112 is shown. The second embodiment has an inner wythe or backup wall 114 of a dry wall construction with a waterproofing membrane 115 disposed thereon. Wallboard 116 is attached to columns or studs 117 and an outer wythe or veneer 118 of facing brick 120. The inner wythe 114 and the outer wythe 118 have a cavity 122 therebetween. Here, the anchoring system has a surface-mounted wall anchor with notched, tubular legs and a swaged veneer tie for receiving reinforcement bars to create a seismic anchoring system.

The anchoring system 110 is surface mounted to the exterior surface 124 of the insulation 126. In this embodiment like the previous one, panels of insulation 126 are disposed on waterproofing membrane 115 and, in turn, on wallboard 116 and columns 117. Successive bed joints 130 and 132 are substantially planar and horizontally disposed and in accord with building standards are 0.375-inch (approx.) in height. Selective ones of bed joints 130 and 132, which are formed between courses of bricks 120, are constructed to receive therewithin the insertion portion of the anchoring system construct hereof. Being surface mounted onto the inner wythe, the anchoring system 110 is constructed cooperatively therewith, and as described in greater detail below, is configured to penetrate through the wallboard at a covered insertion point and to minimize the openings in the waterproofing layer.

For purposes of discussion, the insulation surface 124 of the inner wythe 114 contains a horizontal line or x-axis 134 and an intersecting vertical line or y-axis 136. A horizontal line or z-axis 138, normal to the xy-plane, passes through the coordinate origin formed by the intersecting x- and y-axes. A wall anchor 140 is shown which has a pair of tubular legs 142 which penetrate the insulation 126, the waterproofing membrane 115, and the wallboard 116. Wall anchor 140 is a stamped metal construct which is constructed for surface mounting on inner wythe 114 and for interconnection with veneer tie 144 which, in turn, receives reinforcement 146 therewithin.

The veneer tie 144 is a swaged Byna-Tie® device manufactured by Hohmann & Barnard, Inc., Hauppauge, N.Y. 11788. The veneer tie 144 is shown in FIG. 5 as being emplaced on a course of bricks 120 in preparation for embedment in the mortar of bed joint 130. In this embodiment, the system includes a wall anchor 140, veneer reinforcement 146, and a swaged veneer tie 144. The veneer reinforcement 146 is constructed of a wire formative conforming to the joint reinforcement requirements of ASTM Standard Specification A951-00, Table 1, see supra.

At intervals along a horizontal line on surface 124, wall anchors 140 are surface mounted. In this structure, tubular legs 142 sheathe the mounting hardware 148. The hardware is adapted to thermally isolate the wall anchor 140 with the neoprene sealing washers thereof. The wall anchors 140 are positioned on surface 124 so that the longitudinal axis of a column 117 lies within the yz-plane formed by the longitudinal axes 150 and 152 of upper leg portion 154 and lower leg portion 156, respectively. As best shown in FIGS. 6 and 7, tubular legs base 158 surface when installed, lies in an xy-plane. Upon insertion in the wallboard 116, the base surfaces 158 and 160 rest snugly against the opening formed thereby and serves to cover the opening precluding the passage of air and moisture therethrough, thereby maintaining the insulation integrity. It is within the contemplation of this invention that a coating of sealant or a layer 163 of a polymeric compound—such as a closed-cell foam—be placed on base surfaces 158 for additional sealing. Because of the sheathing of the mounting hardware 148, only two openings are required in insulation 126 for each wall anchor 140. Optionally, a layer of Textroseal® sealant 163 or equivalent distributed by Hohmann & Barnard, Inc., Hauppauge, N.Y. 11788 may be applied under the base surface 158 for additional protection.

In this embodiment, as best seen in FIGS. 6 and 7, strengthening ribs 184 are impressed in the base 158 of wall anchor 140. The ribs 184 are substantially parallel to the bail opening 166 and, when mounting hardware 148 is fully seated so that the base 158 surface rests against the face of insulation 126, the ribs 184 are then raised from the surface of the insulation 126. Thus, the ribs 184 are shown as protruding away the insulation, in a manner opposite that of the first embodiment. This alternative structure is particularly applicable where the outer layer of the inner wythe is noncompressible and does not conform to the rib contour. The ribs 184 strengthen the wall anchor 140 and achieves an anchor with a tension and compression rating of 100 lbf.

The dimensional relationship between wall anchor 140 and veneer tie 144 limits the axial movement of the construct. Each veneer tie 144 has a rear leg 164 opposite the bed-joint deposited portion thereof, which rear leg 164 is formed continuous therewith. The bail opening 166 provides for selective adjustability and, restricts the y-axis 136 movement of the anchored veneer. The horizontal dimension of the bail opening 166 of bail 162 is constructed to be within the predetermined dimensions to limit the z-axis 138 movement in accordance with the building code requirements. The opening is larger horizontally than the diameter of the veneer tie 144. The dimensional relationship of the rear leg 164 to the width of the bail 162 limits the x-axis 134 movement of the construct. For positive interengagement, the front legs 168 and 170 of veneer tie 144 are sealed in bed joint 130 forming a closed loop. For positive interengagement and to prevent disengagement under seismic conditions, the front legs 168 and 170 of veneer tie 144 and the reinforcement wire 146 are sealed in bed joint 30 forming a closed loop.

The anchor 140 is seen in more detail in FIGS. 6 and 7. The upper leg portion 154 and lower leg portion 156 are mounted inboard from the perimeter of base 158 with the leg portions extending parallel the one to the other. The leg portions 154 and 156 are dimensioned so that, upon installation, they extend through wallboard 116 and the endpoints 180 thereof abut the metal studs 117. Although only two leg structures are shown, it is within the contemplation of this invention that more legs could be constructed with each leg portion mounted inboard and having the insertion point 182 of the wallboard 116 covered by the wall anchor body. Because the leg portions 154 and 156 abut the studs 117 only at endpoints 180, the thermal conductivity across the construct is minimal as the cross sectional metal-to-metal contact area is minimized. (There is virtually no heat transfer across the mounting hardware 148 because of the nonconductive washers thereof.

The upper leg 154 and the lower leg 156 of wall anchor 140 are notched at the insertion end forming upper notches 155 and lower notches 157. The notches are dimensioned so that the depths 159 thereof are slightly greater than the combined wallboard 116 and waterproofing membranes 115 thicknesses. The notch excesses form small wells 161 which draw off moisture, condensate or water by relieving any pressure that would drive the same past the waterproofing membranes 115 and toward wallboard 116. This construct maintains the waterproofing integrity.

Figure 8:
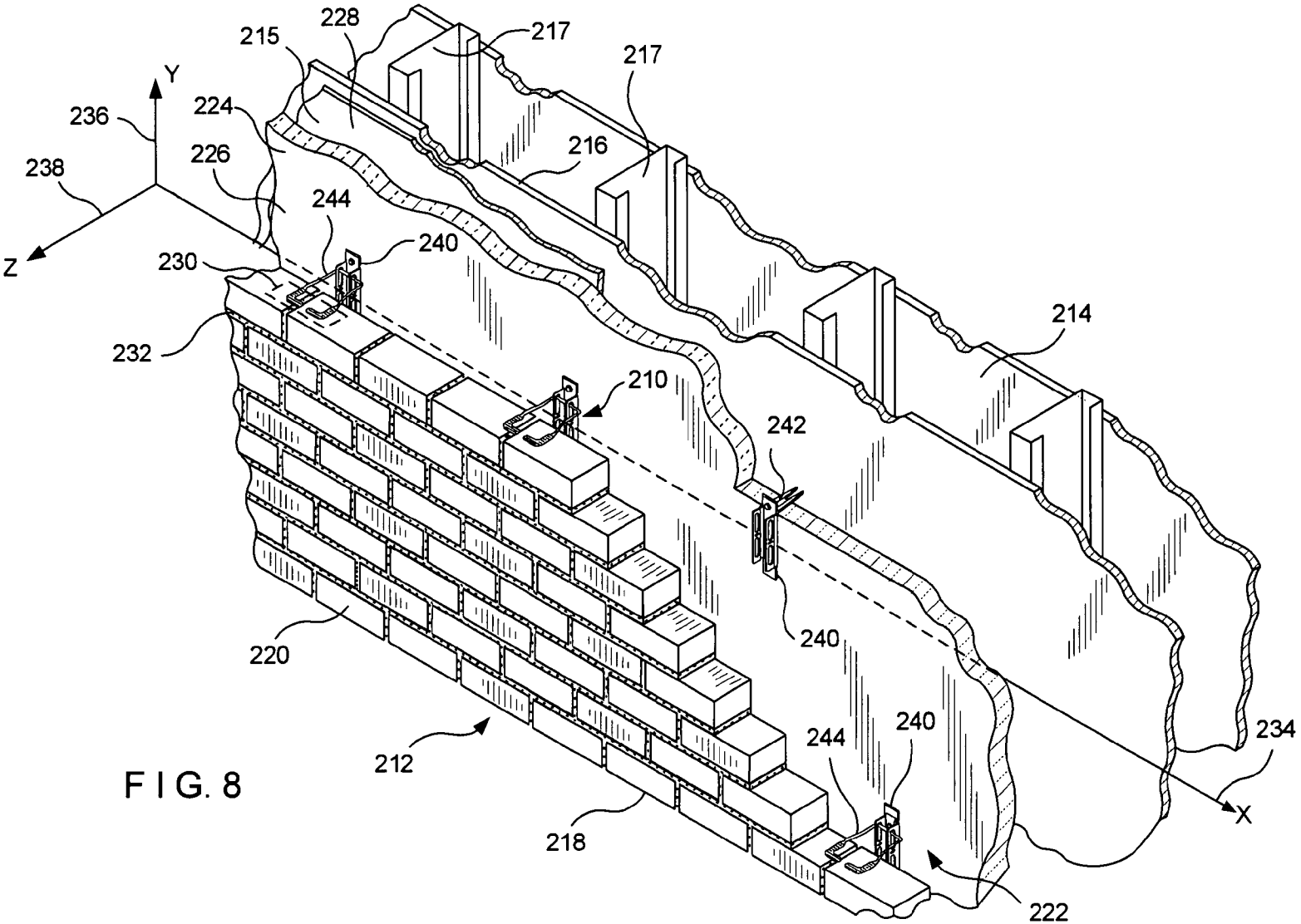
FIG. 8 is a perspective view of a third embodiment of this invention showing a surface-mounted anchoring system for a cavity wall and is similar to FIG. 1, but shows a system employing a notched, folded wall anchor with slotted wings and a low-profile, canted veneer tie.
Figure 10:
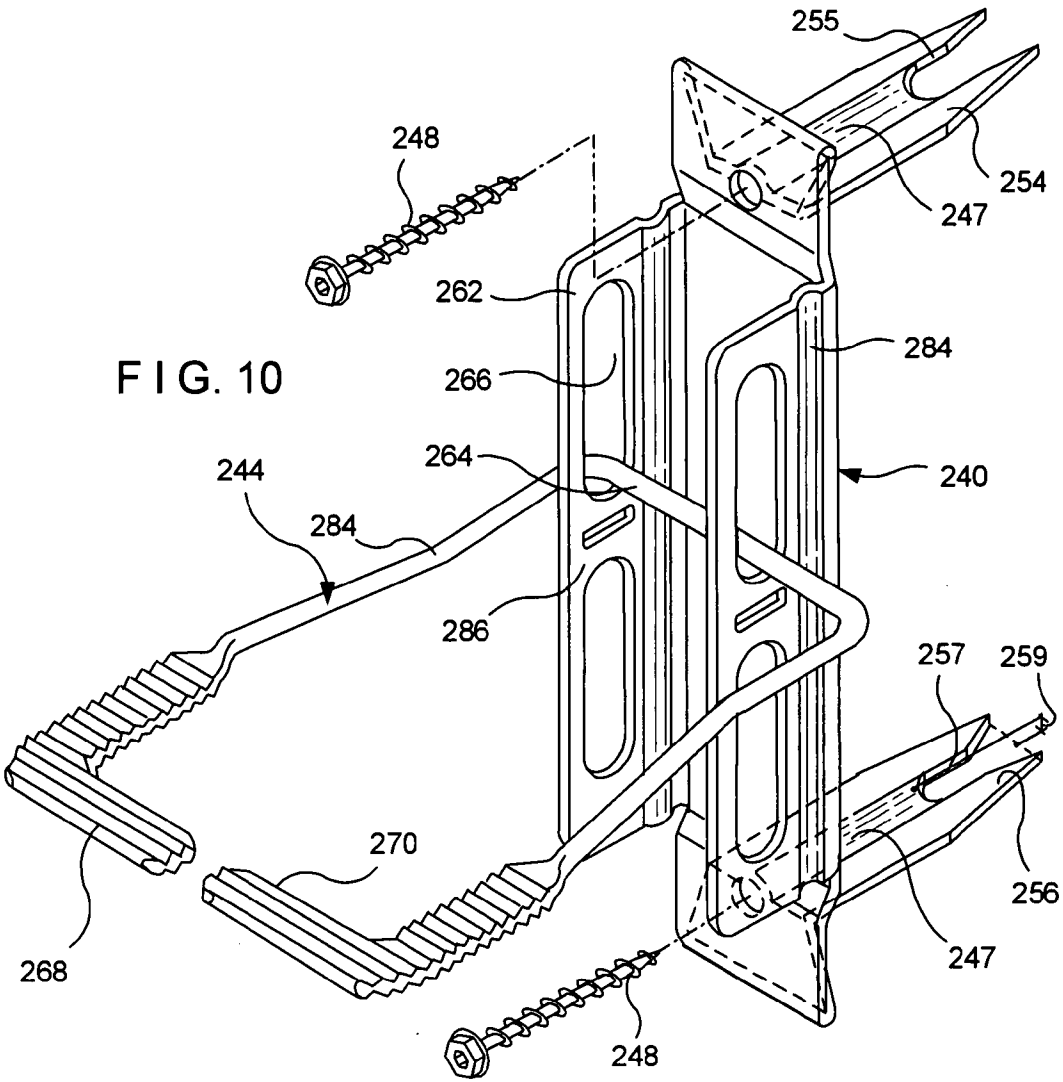
Figure 9:
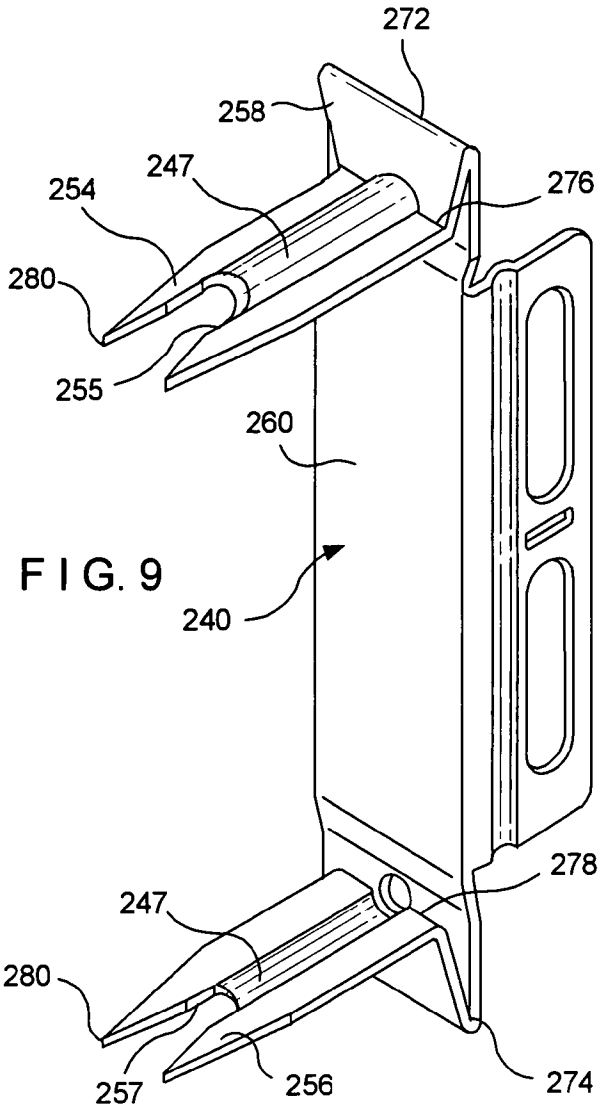
FIG. 9 is a rear perspective view showing the wall anchor with ribbed slotted wings of FIG. 8 having channels for ensheathing the exterior of the mounting hardware; and, FIG. 10 is a partial perspective view of FIG. 8 showing the relationship of the wall anchor and the corresponding veneer tie.

The description which follows is a third embodiment of the surface-mounted anchoring system for cavity walls of this invention. For ease of comprehension, wherever possible similar parts use reference designators 100 units higher than those above. Thus, the veneer tie 244 of the third embodiment is analogous to the veneer tie 144 of the second embodiment. Referring now to FIGS. 8 through 10, the third embodiment of the surface-mounted anchoring system is shown and is referred to generally by the numeral 210. As in the previous embodiments, a wall structure 212 is shown. Here, the third embodiment has an inner externally insulated, wythe or dry wall 214 with a waterproofing membrane 215 disposed thereon. The structure includes a wallboard 216 mounted on columns or studs 217 and an outer wythe or veneer 218 of facing brick 220. The inner wythe 214 and the outer wythe 218 have a cavity 222 therebetween. The anchoring system has a notched, surface-mounted wall anchor with slotted wing portions or receptors for receiving the veneer tie portion of the anchoring system and a low-profile box tie, see U.S. Pat. No. 6,279,283 supra.

The anchoring system 210 is surface mounted to the exterior surface 224 of the insulation 226. In this embodiment panels of insulation 226 are disposed on the wallboard 216. Successive bed joints 230 and 232 are substantially planar and horizontally disposed and in accord with building standards are 0.375-inch (approx.) in height. Selective ones of bed joints 230 and 232, which are formed between courses of bricks 220, are constructed to receive therewithin the veneer anchor insertion portion of the anchoring system construct hereof. Being surface mounted onto the inner wythe, the anchoring system 210 is constructed cooperatively therewith, and as described in greater detail below, is configured to penetrate through the insulation at a covered insertion point to maintain insulation integrity and to minimize penetration of the waterproofing membrane 215 to maintain waterproofing integrity.

For purposes of discussion, the surface 224 of the insulation 226 contains a horizontal line or x-axis 234 and an intersecting vertical line or y-axis 236. A horizontal line or z-axis 238, normal to the xy-plane, passes through the coordinate origin formed by the intersecting x- and y-axes. A folded wall anchor 240 is shown which has a pair of legs 242 which penetrate the insulation 226, waterproofing membrane 215, and wallboard 216. Folded wall anchor 240 is a stamped metal construct which is constructed for surface mounting on inner wythe 214 and for interconnection with veneer tie 244.

The veneer tie 244 is adapted from the low-profile box Byna-Tie® device manufactured by Hohmann & Barnard, Inc., Hauppauge, N.Y. 11788 under U.S. Pat. No. 6,279,283. The veneer tie 244 is shown in FIG. 8 as being emplaced on a course of bricks 220 in preparation for embedment in the mortar of bed joint 230. In this embodiment, the system includes a folded wall anchor 240 and a canted veneer tie 244.

At intervals along a horizontal line on surface 224, folded wall anchors 240 are surface-mounted using mounting hardware 248. In this structure, channels 247 sheathe the exterior of mounting hardware 248. The folded wall anchors 240 are positioned on surface 224 at the intervals required by the applicable building codes. The upper leg portion 254 and lower leg portion 256 are folded, as best shown in FIG. 9, so that the base surface 258 of the legs and the intermediate base surface 260 are substantially coplanar and, when installed, lie in an xy-plane. Upon insertion in insulation 226, the base surfaces 258 and 260 rest snugly against the opening formed thereby and serves to cover the opening precluding the passage of air and moisture therethrough, thereby maintaining the insulation integrity. It is within the contemplation of this invention that a coating of sealant or a layer of a polymeric compound—such as a closed-cell foam—be placed on base surfaces 258 and 260 for additional sealing. With the leg portions 254 and 256 sheathing the mounting hardware, only two openings in the insulation are required for mounting and the disruption of the insulative integrity is minimized thereby.

In this third embodiment, slotted wing portions 262 therealong are bent upwardly (when viewing legs 242 as being bent downwardly) from intermediate base 260 for receiving veneer tie 244 therethrough. The dimensional relationship between wall anchor 240 and veneer tie 244 limits the axial or xz-plane movement of the construct. Each veneer tie 244 has a rear leg 264 opposite the bed-joint deposited portion thereof, which rear leg 264 is formed continuous therewith. The slots 266 provide for z-axis 238 limitation and for adjustability along the y-axis 236 movement of the anchored veneer. The opening of the slot 266 of wing portions 262 is constructed to be within the predetermined dimensions to limit the z-axis 238 movement in accordance with the building code requirements. The slots 266 are slightly larger horizontally than the diameter of the tie 244. The dimensional relationship of the rear leg 264 to the width of spacing between wing portions 262 limits the x-axis movement of the construct. For positive interengagement, the front legs 268 and 270 of veneer tie 244 are sealed in bed joint 230 forming a closed loop.

The folded wall anchor 240 is seen in more detail in FIGS. 9 and 10. The upper and lower legs 242 are folded 180° about end seams 272 and 274, respectively, and then 90° at the inboard seams 276 and 278 respectively, so the leg portions 254 and 256 extend parallel the one to the other. The leg portions 254 and 256 are dimensioned so that, upon installation, they extend through insulation panels 226 and the endpoints 280 thereof abut the surface of metal studs 217. Because the insertion point into insulation 226 of the leg portions 254 and 256 is sealingly covered by the structure, the water and water vapor penetration into the backup wall is minimal. (There is virtually no heat transfer across the mounting hardware 248 because of the nonconductive washers thereof.)

The upper leg portion 254 and lower leg portion 256 of wall anchor 240 are notched at the insertion end thereof forming upper notch 255 and lower notch 257. The notches are dimensioned so that the depths 259 thereof are slightly greater than the combined height of the wallboard 216 and the waterproofing membrane 217. The excess portions of the notches 255 and 257 form small wells which draw off moisture condensate, or water and relieve pressure that would drive the same toward the wallboard 216. With this structure the waterproofing integrity is maintained.

In the veneer tie shown in FIGS. 8 and 10, a bend is made at a point of inflection 284. This configuring of the veneer tie 244, compensates for the additional strengthening of wall anchor 240 at crossbar 286. Thus, if the bed joint 230 is exactly coplanar with the strengthening crossbar 286 the bent veneer tie 244 facilitates the alignment thereof.

In this embodiment, as best seen in FIGS. 9 and 10, strengthening ribs 284 are impressed into wing portions 262 adjacent and parallel to the base 258 of wall anchor 240. The ribs 284 are substantially parallel to the bail opening 266. When mounting hardware 248 is fully seated, the base surface 258 rests against the face of insulation 226 without any interface with the ribs 284. The ribs 284 strengthen the wall anchor 240 and achieves an anchor with a tension and compression rating of 100 lbf.

In the above description of the folded wall anchors of this invention various configurations are described and applications thereof in corresponding anchoring systems are provided. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A surface-mounted anchoring system for use in the construction of a wall having an inner wythe and an outer wythe, said outer wythe formed from a plurality of successive courses with a bed joint between each two adjacent courses, said inner wythe and said outer wythe in a spaced apart relationship the one with the other forming a cavity therebetween, said inner wythe having an exterior layer of insulation and wallboard with a waterproofing layer therebetween, said surface-mounted anchoring system comprising:

a wall anchor constructed from a planar base having two major faces being the mounting surface and the outer surface, said mounting surface having a perimeter, said wall anchor, in turn, comprising;

a pair of legs each having a base surface and a leg portion extending from the base surface from a location within said perimeter of said mounting surface with the longitudinal axis of each of said leg portions being substantially normal to said mounting surface and having a channel along said axis adapted for sheathing mounting hardware, said leg portions adapted for insertion at a predetermined insertion point into said exterior layer of said inner wythe, said leg portions each cutaway at the end opposite said mounting surface thereby adapted to minimize, upon installation, the penetration area into said waterproofing layer and said wallboard;

a covering portion formed at said mounting surface of said planar base, said covering portion formed from said mounting surface and the base surface and adapted to preclude penetration of air, moisture and water vapor into said exterior layer; and, a veneer tie interlockingly connected with said wall anchor and adapted for embedment in said bed joint of said outer wythe.

2. A surface-mounted anchoring system as described in claim 1, wherein said perimeter has two sides and two ends, said pair of leg portions is formed from said planar base with said channel impressed therein, said cutaway removing a portion of said channel, thereby forming a notch at the end opposite said mounting surface said pair of leg portions depending from said mounting surface at a position located inward from said sides and said ends of said perimeter to be positioned completely within the perimeter of said mounting surface.

3. A surface-mounted anchoring system as described in claim 2, wherein the depth of said notch is adapted to be greater than the combined thickness of said wallboard and said waterproofing layer.

4. A surface-mounted anchoring system as described in claim 3, wherein said notch, upon surface-mounting of said wall anchor, forms small wells in the portion of the notch extending into said insulation, said wells adapted to entrain water vapor, condensate and water and to relieve pressure from driving said water vapor, condensate, and water into said wallboard.

5. A surface-mounted anchoring system as described in claim 2, wherein each said channel of said pair of leg portions further comprises a guide for maintaining said mounting hardware normal to said mounting surface.

6. A surface mounting anchoring system as described in claim 5, wherein said guide is a portion of said channel formed into a ring for encapturing said mounting hardware.

7. A surface-mounted anchoring system as described in claim 1, wherein said wall anchor further comprises;

an apertured receptor portion adjacent a second face of said planar base said apertured receptor portion adapted to limit displacement of said outer wythe toward and away from said inner wythe; and, at least one strengthening rib impressed in said planar base parallel to said apertured receptor portion;

whereby said wall anchor, strengthened by at least one strengthening rib is constructed to meet a 100 lbf. tension and compression rating.

8. A surface-mounted anchoring system as described in claim 7, wherein each said insertion point in said insulation is adapted to accommodate one of said leg portions and the associated mounting hardware.

9. A surface-mounted anchoring system as described in claim 7, wherein each said strengthening rib is impressed to depend from said mounting surface and adapted, upon surface mounting of said wall anchor, to be pressed into said insulation of said inner wythe and to seal the wall anchor insertion region.

10. A surface-mounted wall anchor for use in the construction of a wall having an inner wythe and an outer wythe, said outer wythe formed from a plurality of successive courses with a bed joint between each two adjacent courses, said inner wythe and said outer wythe in a spaced apart relationship the one with the other forming a cavity therebetween, said inner wythe having an exterior layer of insulation and wallboard with a waterproofing layer therebetween, said surface-mounted anchor comprising:

a planar base having two major faces being the mounting surface and the outer surface, said wall anchor;

a pair of legs each having a base surface and a leg portion extending from the base surface from a location within said perimeter of said mounting surface an inboard location thereof with the longitudinal axis of each of said leg portion being substantially normal to said face and having a channel along said axis adapted for sheathing mounting hardware, said leg portions adapted for insertion at a predetermined insertion point into said exterior layer of said inner wythe, said leg portions each cutaway at the end opposite said mounting surface thereby adapted to minimize, upon installation, the penetration area into said waterproofing layer and said wallboard; and, a covering portion formed at said mounting surface of said planar base, said covering portion formed from said mounting surface and the base surface and adapted to preclude penetration of air, moisture and water vapor into said exterior layer.

11. A surface-mounted wall anchor as described in claim 10, wherein said perimeter has two sides and two ends, said pair of leg portions is formed from said planar base with said channel impressed therein, said cutaway removing a portion of said channel, thereby forming a notch at the end opposite said mounting surface said pair of leg portions depending from said mounting surface at a position located inward from said sides and said ends of said perimeter to be positioned completely within the perimeter of said mounting surface.

12. A surface-mounted wall anchor as described in claim 11, wherein the depth of said notch is adapted to be greater than the combined thickness of said wallboard and said waterproofing layer.

13. A surface-mounted wall anchor as described in claim 12, wherein said notch, upon surface-mounting of said wall anchor, forms small wells in the portion of the notch extending into said insulation, said wells adapted to entrain water vapor, condensate and water and to relieve pressure from driving said water vapor, condensate, and water into said wallboard.

14. A surface-mounted wall anchor as described in claim 11, wherein each said channel of said pair of leg portions further comprises a guide for maintaining said mounting hardware normal to said mounting surface.

15. A surface-mounted wall anchor as described in claim 14, wherein said guide is a portion of said channel formed into a ring for encapturing said mounting hardware.

16. A surface-mounted wall anchor as described in claim 10, wherein said wall anchor further comprises:

an apertured receptor portion adjacent a second face of said planar base, said apertured receptor portion adapted to limit displacement of said outer wythe toward and away from said inner wythe; and, at least one strengthening rib impressed in said planar base parallel to said apertured receptor portion;

whereby said wall anchor, strengthened by at least one strengthening rib is constructed to meet a 100 lbf. tension and compression rating 17. A surface-mounted wall anchor as described in claim 16, wherein each one of said leg portions and the associated mounting hardware therefore is adapted to be accommodated within said insertion point of said insulation.

18. A surface-mounted anchoring system as described in claim 16, wherein each said strengthening rib is impressed to depend from said mounting surface and adapted, upon surface mounting of said wall anchor, to be pressed into said insulation of said inner wythe and to seal the wall anchor insertion region.

* * * * *